US005495789A

United States Patent [19]

Ogura et al.

[11] Patent Number: 5,495,789

[45] Date of Patent: Mar. 5, 1996

[54] SWASH PLATE TYPE COMPRESSOR WITH LUBRICATING MECHANISM BETWEEN THE SHOE AND SWASH PLATE

[75] Inventors: Toshiyuki Ogura, Sawa; Kenji Saito, Ashikaga; Shigemi Shimizu, Sawa; Masakatsu Sakaki, Isesaki, all of Japan

[73] Assignee: Sanden Corporation, Isesaki, Japan

[21] Appl. No.: 207,640

[22] Filed: Mar. 9, 1994

[30] Foreign Application Priority Data

| | | | |
|---|---|---|---|
| Mar. 10, 1993 | [JP] | Japan | 5-010140 U |
| Mar. 12, 1993 | [JP] | Japan | 5-010753 U |
| Mar. 18, 1993 | [JP] | Japan | 5-012092 U |
| May 18, 1993 | [JP] | Japan | 5-025710 U |
| Dec. 9, 1993 | [JP] | Japan | 5-065784 U |

[51] Int. Cl.[6] ..... F01B 3/00

[52] U.S. Cl. ..... 92/71; 92/154; 92/155

[58] Field of Search ..... 92/70, 71, 154, 92/155; 91/501, 502; 417/269

[56] References Cited

U.S. PATENT DOCUMENTS

| | | | |
|---|---|---|---|
| 1,714,145 | 5/1929 | Sperry . | |
| 1,839,592 | 1/1932 | Reynolds . | |
| 2,821,932 | 2/1958 | Lucien . | |
| 2,881,973 | 4/1959 | Ricardo | 92/71 |
| 3,761,202 | 9/1973 | Mitchell . | |
| 3,958,901 | 5/1976 | Drevet . | |
| 4,505,016 | 3/1985 | Roberts . | |
| 4,522,112 | 6/1985 | Nomura | 417/269 |
| 4,546,692 | 10/1985 | Lotter et al. . | |
| 4,586,876 | 5/1986 | Kato et al. . | |
| 4,763,563 | 8/1988 | Ikeda et al. | 92/71 |
| 4,781,539 | 11/1988 | Ikeda et al. | 92/71 |
| 5,013,219 | 5/1991 | Hicks et al. | 417/269 |
| 5,017,095 | 5/1991 | Burgess et al. | 417/269 |
| 5,131,319 | 7/1992 | Ono et al. . | |

FOREIGN PATENT DOCUMENTS

| | | | |
|---|---|---|---|
| 1104109 | 6/1955 | France . | |
| 1184849 | 2/1959 | France . | |
| 1061184 | 9/1956 | Germany . | |
| 538013 | 4/1955 | Italy . | |
| 114888 | 9/1980 | Japan | 91/502 |

*Primary Examiner*—F. Daniel Lopez
*Attorney, Agent, or Firm*—Baker & Botts

[57] ABSTRACT

A swash plate type refrigerant compressor comprises a compressor housing enclosing therein a crank chamber, a suction chamber and a discharge chamber. A swash plate is tiltably connected to the drive shaft and has two sliding surfaces at axial sides thereof. The swash plate includes a sliding surface which engages a plurality of pairs of shoes. The shoes couple the swash plate to the pistons so that the pistons may be driven in a reciprocating motion within the cylinder bores upon rotation of the swash plate. At least one groove is formed in the sliding contact surfaces between the swash plate and the shoes. The groove captures and retains lubricating oil in the refrigerant in response to the rotation of the swash plate.

10 Claims, 7 Drawing Sheets

SWASH PLATE TYPE COMPRESSOR WITH LUBRICATING MECHANISM BETWEEN THE SHOE AND SWASH PLATE

BACKGROUND OF THE INVENTION

1. Field of the Invention

The present invention generally relates to a swash plate type refrigerant compressor and, more particularly, to a lubricating mechanism between the shoe and swash plate.

2. Description of the Prior Art

A swash plate type refrigerant compressor suitable for use in an automotive air condition system is disclosed in, for example, U.S. Pat. No. 4,568,252 to Ikeda et al. The Ikeda et al. swash plate compressor includes a pair of axially aligned front and rear cylinder blocks enclosed at both ends by front and rear housings. Valve plates are positioned between the respective cylinder blocks and the front and rear housings. The front and rear housings form suction chambers and discharge chambers, and a plurality of aligned cylinder bores are arranged around the central axis of the cylinder blocks. Each of the cylinder bores have interconnecting suction chambers and discharge chambers formed in the front and rear housings. The cylinder blocks also have a central longitudinal bore formed therein. A drive shaft is rotatably mounted in the longitudinal bores. A swash plate chamber is formed between the cylinder blocks and a swash plate, keyed on the drive shaft, is rotatably received is the swash plate chamber.

The swash plate rotates with the drive shaft and operatively engages double-headed pistons slidably fitted in the cylinder bores. More specifically, the swash plate is coupled to the pistons through shoes. The shoes provide a universal coupling allowing a reciprocatory compressing motion of the pistons within the cylinder bores in response to the rotation of the swash plate. The central portion of each of the double headed pistons is provided with a recess through which the swash plate passes during the rotation thereof, and a pair of spherical sockets to receive the shoes. Each of the shoes has a circular flat face in sliding contact with the oblique face of the swash plate and a half-spherical face in sliding engagement with the socket of the associated piston.

When the Ikeda et al. compressor is used for compressing a refrigerant gas in the air-conditioning system of a vehicle, the refrigerant gas, which contains a lubricating oil, is introduced from outside of the air-conditioning circuit into the suction chamber, via the swash plate chamber, and is discharged from the compressor to other components in the air-conditioning circuit. The lubricating oil contained in the refrigerant gas lubricates the contacting surfaces of the shoes and the swash plate and respective sockets of the pistons. However, since the circular flat surface of each shoe and the oblique surface of the swash plate are in close contact, sometimes an insufficient amount of lubricating oil is supplied to the contacting surfaces of the shoes and the swash plate. Moreover, since the lubricating oil entering the swash plate chamber is subjected to the centrifugal force of the rotating swash plate and is scattered radially outward from the swash plate, the lubricating oil is not retained between the shoes and the swash plate. Consequently, the engaging surfaces between the shoes and the double headed pistons and the swash plate are sometimes insufficiently lubricated.

This lack of lubrication is even more pronounced when the engagement between the shoes and the pistons is located remotely from the return gas inlet through which the refrigerant gas is introduced into the swash plate chamber. As a result, abrasion between the swash plate and the flat surfaces of the shoes can occur during the operation of the swash plate type compressor due to an insufficient or a lack of lubrication. This can cause inaccurate reciprocation by the double headed pistons, i.e., lost motion of the pistons due to play between the pistons and the shoes, and noise during the operation of the compressor. Further, in an extreme case, the insufficient or lack of lubrication can cause excessive frictional contact between the oblique face of the swash plate and the flat faces of the respective shoes, resulting in the generation of high temperatures, which can cause the contacting faces of the swash plate and shoes to seize.

SUMMARY OF THE INVENTION

It is an object of the preferred embodiments to provide a piston type compressor having an improved lubrication mechanism between the shoes and swash plate.

It is an another object of the preferred embodiments to provide sufficient lubrication between the swash plate and respective shoes when starting the compressor.

According to the preferred embodiments, a swash plate type refrigerant compressor comprises a compressor housing enclosing therein a crank chamber, a suction chamber and a discharge chamber. The compressor housing includes a cylinder block having a plurality of cylinder bores formed therein. A plurality of pistons are slidably disposed within each of the cylinder bores. A drive shaft is rotatably supported in the cylinder block. A swash plate is connected at an angle to the drive shaft and includes sliding surfaces which engage a plurality of pairs of shoes. The shoes couple the swash plate to the pistons so that the pistons may be driven in a reciprocating motion within the cylinder bores upon the rotation of the swash plate. At least one lubricating mechanism is arranged in the sliding surface region of the swash plate for capturing and retaining lubricating oil during the rotation of the swash plate. The lubricating mechanism considerably reduces the local abrasion of the contact surfaces between the swash plate and the shoes, and seizure of the shoes on the swash plate during the operation of the swash plate type compressor is effectively prevented.

Further objects, features and other aspects of the present invention will be understood from the detailed description of the preferred embodiments with reference to the annexed drawings.

DETAILED DESCRIPTION OF THE PREFERRED EMBODIMENTS

Figure 1:
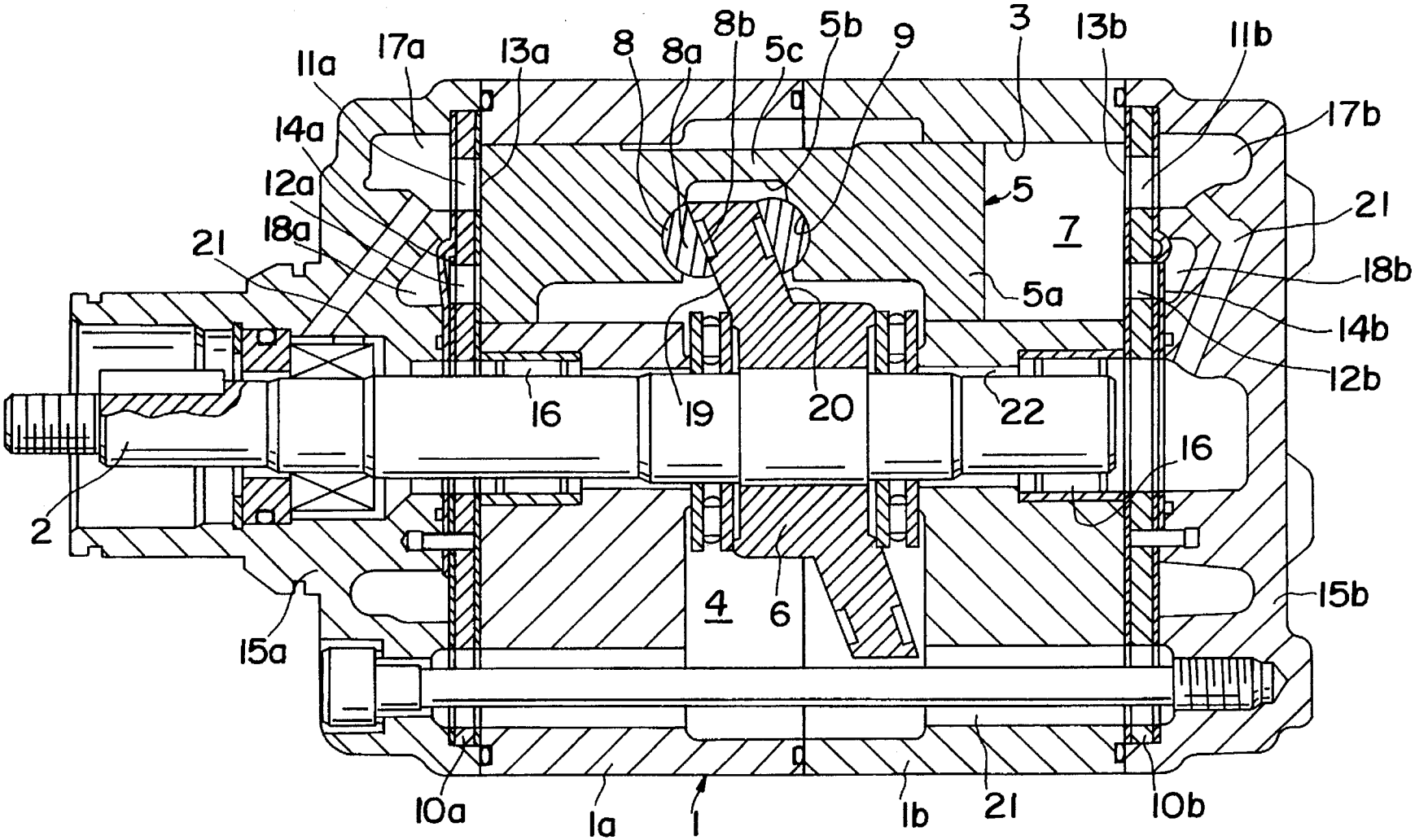
FIG. 1 is a longitudinal sectional view of a swash plate refrigerant compressor in accordance with a first preferred embodiment.

With reference to FIG. 1, there is shown a swash plate type compressor according to a first preferred embodiment comprising a front cylinder block 1*a* and a rear cylinder block 1*b* together defining a combined cylinder block 1. A center bore 22 for receiving drive shaft 2 is formed through combined cylinder block 1. Drive shaft 2 is rotatably supported by a pair of anti-friction bearings 16 seated in center bore 22 of combined cylinder block 1. One end of drive shaft 2 projects from a front housing 15*a*, and via an electromagnetic clutch (not shown), is connectable to a vehicle engine so that a rotary drive force is transmitted from the engine to drive shaft 2 in response to energization of the electromagnetic clutch. A plurality of axially aligned cylinder bores 3 are formed in combined cylinder block 1.

Each cylinder bore 3 has a front cylinder bore section formed in front cylinder block 1*a* and a rear cylinder bore section formed in rear cylinder block 1*b*, respectively. The front and rear cylinder bores are separated by swash plate chamber 4. Double headed piston 5, having front and rear piston heads, is slidably fitted in each cylinder bore 3 for reciprocation therein. A compression chamber 7 is formed in each cylinder bore 3 between front valve plate 10*a* and rear valve plate 10*b*, and the opposite ends of respective double headed pistons 5. Swash plate 6, having front and rear oblique faces inclined with respect to the axis of drive shaft 2, is fixedly mounted on drive shaft 2 for rotation within swash plate chamber 4. The front and rear oblique faces of swash plate 6 comprise front axial surface 19 and rear axial surface 20, which are in sliding contact with shoes 8. Shoes 8 are retained between swash plate 6 and pistons 5 so that, in response to the rotation of swash plate 6, pistons 5 reciprocate within cylinder bores 3. Each of double headed pistons 5 have front and rear piston heads 5*a* formed on the opposite ends thereof, and a cylindrical connecting portion 5*c* having therein a central recessed portion 5*b* for receiving shoes 8 as well as to permit rotation of swash plate 6 therethrough. Within central recessed portion 5*c* is formed a pair of spherical sockets 9 for receiving shoes 8. Spherical sockets 9 and shoes 8 form a pair of ball-and-socket joints between front and rear piston heads 5*a* and front axial surface 19 and rear axial surface 20 of swash plate 6. Each of shoes 8 has a spherical portion 8*a* complementary with spherical socket 9 and circular flat face 8*b* in sliding contact with front axial surface 19 and rear axial surface 20 of swash plate 6.

Front housing 15*a* and rear housing 15*b* close respective axial open ends of combined cylinder block 1. Front valve plate 10*a* and rear valve plate 10*b* are placed between front housing 15*a* and front cylinder block 1*a* and between rear housing 15*b* and rear cylinder block 1*b*, respectively. Annular suction chamber 17*a* and annular discharge chamber 18*a* concentrically formed in front housing 15*a* in such a manner that both chambers 17*a* and 18*a* communicate with each cylinder bore 3. Similarly, annular suction chamber 17*b* and annular discharge chamber 18*b* are concentrically formed in rear housing 15*b* in such a manner that both chambers 17*b* and 18*b* communicate with each cylinder bore 3. Discharge chambers 18*a* and 18*b* are arranged near the respective centers of front and rear housings 15*a* and 15*b* and are surrounded by associated suction chambers 17*a* and 17*b*, respectively.

Suction ports 11*a* and 11*b* are formed in front and rear valve plates 10*a* and 10*b*, respectively, so as to provided a fluid communication between suction chambers 17*a* and 17*b* and each of cylinder bores 3 in response to the opening of suction valves 13*a* and 13*b*, respectively, during the intake stroke of the respective piston heads 5*a*. Similarly, discharge ports 12*a* and 12*b* are formed in front and rear valve plates 10*a* and 10*b*, respectively, so as to provide a fluid communication between discharge chambers 18*a* and 18*b* and each of cylinder bores 3 in response to the opening of discharge valves 14*a* and 14*b*, respectively, during the compression stroke of the respective piston heads 5*a*.

The operation of the compressor having the above-described construction is described below.

When the electromagnetic clutch (not shown) is connected so that the rotary drive force of the vehicle engine is transmitted to drive shaft 2, swash plate 6 rotates within swash plate chamber 4. Therefore, swash plate 6, which is operatively engaged with the respective pistons 5, via the respective pairs of shoes 8, causes the continuous reciprocating motion of pistons 5.

Refrigerant gas exiting an evaporator (not shown) of the air-conditioning circuit enters swash plate chamber 4 of the compressor through a suction conduit (not shown). The refrigerant gas then flows through the gap between drive shaft 2 and central bore 22, through anti-friction bearings 16, through passages 21 and into suction chamber 17*a* and 17*b* of front and rear housings 15*a* and 15*b*. Subsequently, the refrigerant in suction chambers 17*a* and 17*b* enters the plurality of cylinder bores 3 through suction ports 11*a* and 11*b* in response to successive opening of suction valves 13*a* and 13*b* caused by the cyclic pumping motions of piston heads 5*a*. The refrigerant pumped into the cylinder bores 3 is then compressed during the compressing stroke of the respective piston heads 5*a*. The compressed refrigerant gas is further forcibly sent into discharge chambers 18*a* and 18*b* through discharge ports 12*a* and 12*b* of valve plates 10*a* and 10*b* in response to the successive opening of discharge valves 14*a* and 14*b* during the cyclic compression stroke of respective piston heads 5*a*. The compressed refrigerant gas is then discharged to another element in the air-conditioning circuit, e.g., a condenser.

Figure 2:
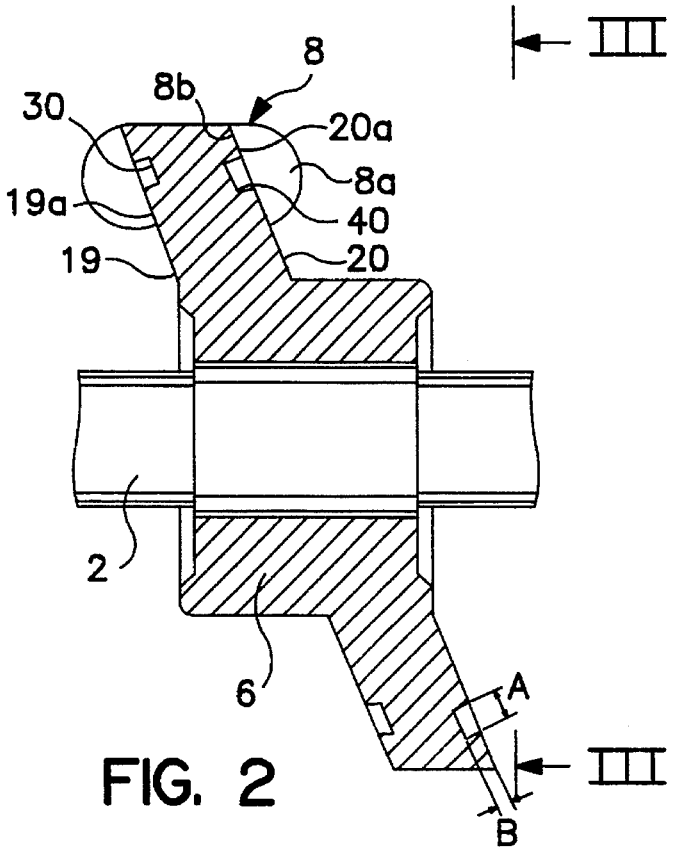
FIG. 2 is an enlarged cross-sectional view of a swash plate supported on a drive shaft and shoes engaged with the swash plate in accordance with a first preferred embodiment.
Figure 3:
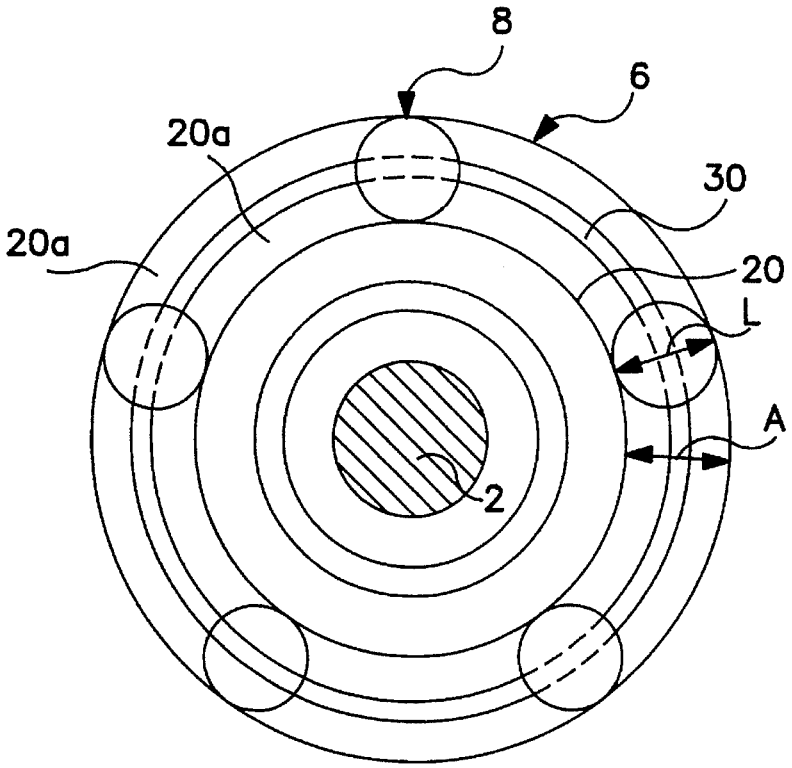
FIG. 3 is a side view of the swash plate, taken along the line III—III of FIG. 2.

FIGS. 2 and 3 illustrate a first preferred embodiment. Front axial surface 19 and rear axial surface 20 of swash plate 6 include sliding surface regions 19*a* and 20*a* which slidably contact circular flat surface 8*b* of shoes 8 according to the reciprocating motion of pistons 5. Front axial surface 19 and rear axial surface 20 of swash plate 6 have grooves 30 and 40, respectively, to capture and retain the refrigerant gas for lubricating sliding surface regions 19*a* and 20*a* of swash plate 6 and shoes 8. Grooves 30 and 40 are concentric with the circumference of swash plate 6 and are within sliding surface regions 19*a* and 20*a* of swash plate 6. As best seen in FIG. 2, grooves 30 have rectangular cross-sections. Alternatively grooves 30 and 40 may have a circular arc or triangular cross section. Still further grooves 30 and 40 may be a plurality of separated grooves arranged equiangularly on each sliding surface region 19*a* and 20 of swash plate 6. The radial width A of grooves 30 and 40 is preferably less than a third of the diameter L of shoes 8. The depth B of grooves 30 and 40 is preferably less than about 2 mm.

If the radial width A of grooves 30 and 40 significantly exceeds about 2 mm, the engaging area between circular flat surface 8*b* of shoes 8 and the sliding surface region 19*a* and 20*a* becomes too small. Consequently, circular flat surface 8*b* of shoes 8 becomes subjected to large reaction forces from pistons 5. On the other hand, if radial width A of grooves 30 and 40 are too small, grooves 30 and 40 fail to capture enough of the lubricating oil contained in the refrigerant gas.

Alternatively, the first preferred embodiment may have grooves 30 and 40 defining half-circles corresponding to the bottom dead center of pistons 5. The arrangement accounts for the fact that shoes 8 thrust toward swash plate 6 in response to the reaction force of pistons 5 during the compression stage.

In the first preferred embodiment, oil in the refrigerant gas fills grooves 30 and 40 during normal operation of the compressor, and also is captured in grooves 30 and 40 upon initially starting of the compressor. As a result, local abrasion between swash plate 6 and shoes 8 can be considerably decreased and seizure of shoes 8 on swash plate 6 is effectively prevented.

Figure 4:
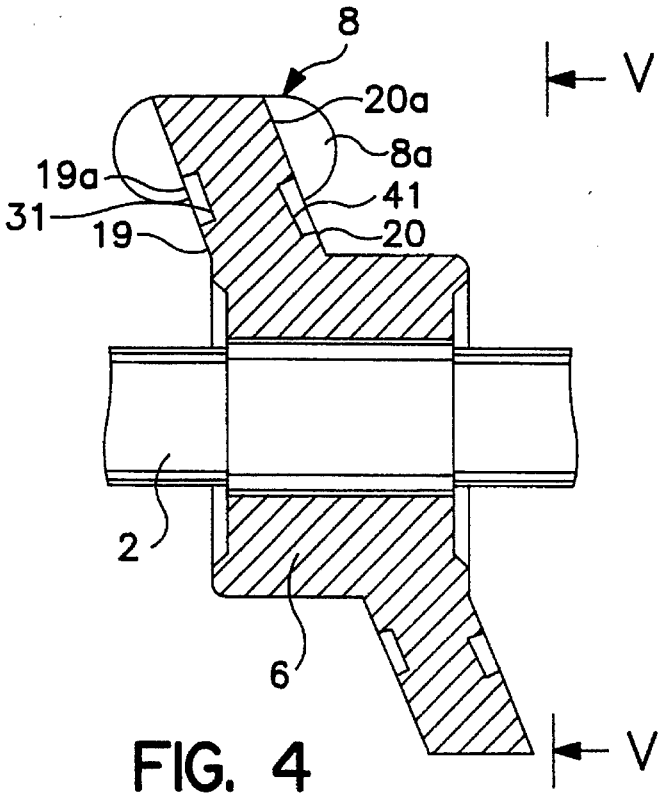
FIG. 4 is an enlarged cross-sectional view of a swash plate supported on a drive shaft and shoes engaging the swash plate in accordance with a second preferred embodiment.
Figure 5:
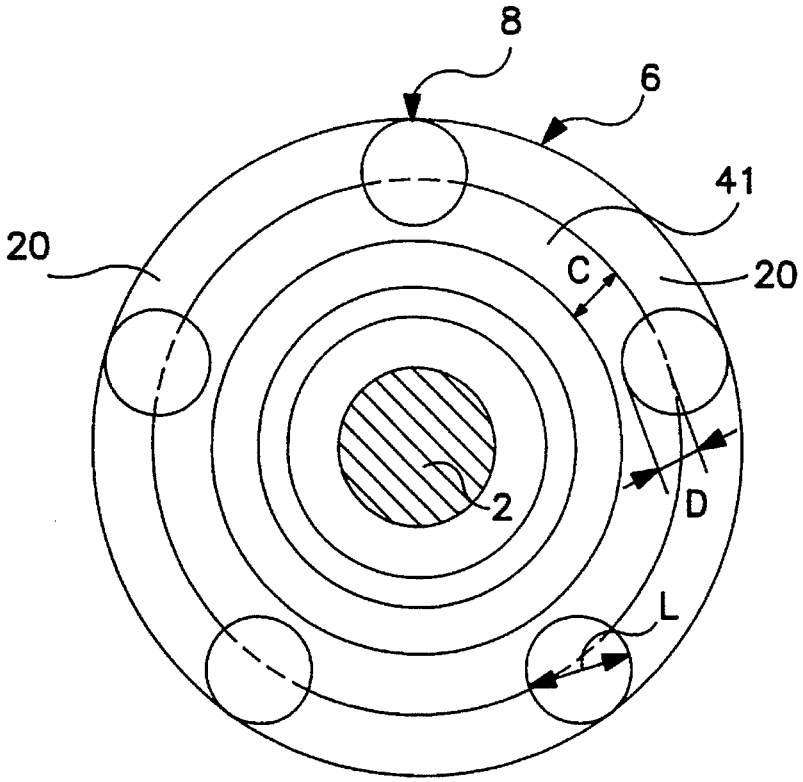
FIG. 5 is a side view of the swash plate, taken along the line of V—V of FIG. 4.

FIGS. 4 and 5 illustrate a second preferred embodiment. This embodiment differs from the previous embodiment in that grooves 31 and 41 extend beyond sliding surface region 19*a* and 20*a* in the direction of drive shaft 2. The radial length D is preferably less than a third of the diameter L of shoes 8. Width C of groove 41 is preferably larger than radial length D. Further, grooves 31 and 41 may be a plurality of separated grooves arranged equiangularly in each of the front axial surface 19 and rear axial surface 20. Further in this arrangement, grooves 31 and 41 may comprise half-circles corresponding to the bottom dead center of pistons 5. In either configuration of the second preferred embodiment, oil in the refrigerant gas is constantly supplied to grooves 31 and 41.

Figure 6:
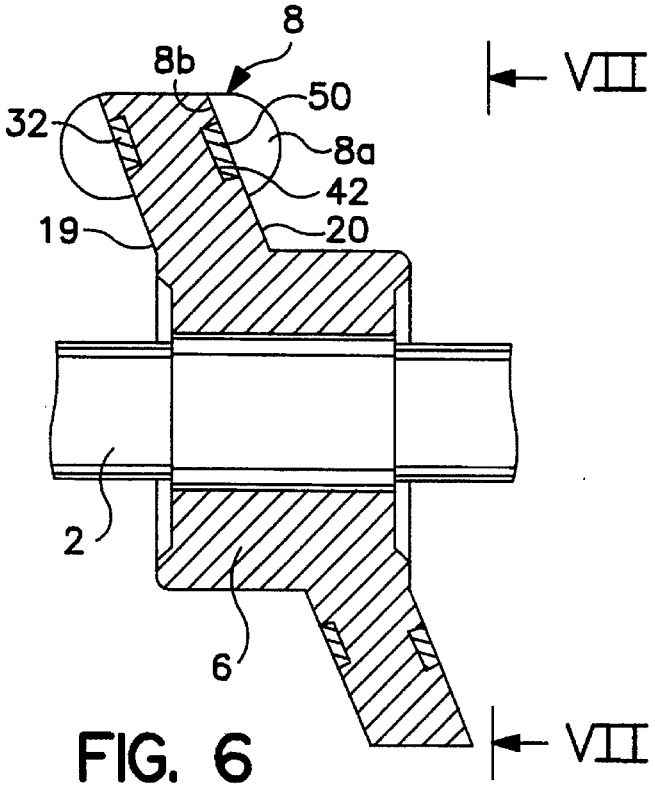
FIG. 6 is an enlarged cross-sectional view of a swash plate supported on a drive shaft and shoes engaging the swash plate in accordance with a third preferred embodiment.
Figure 7:
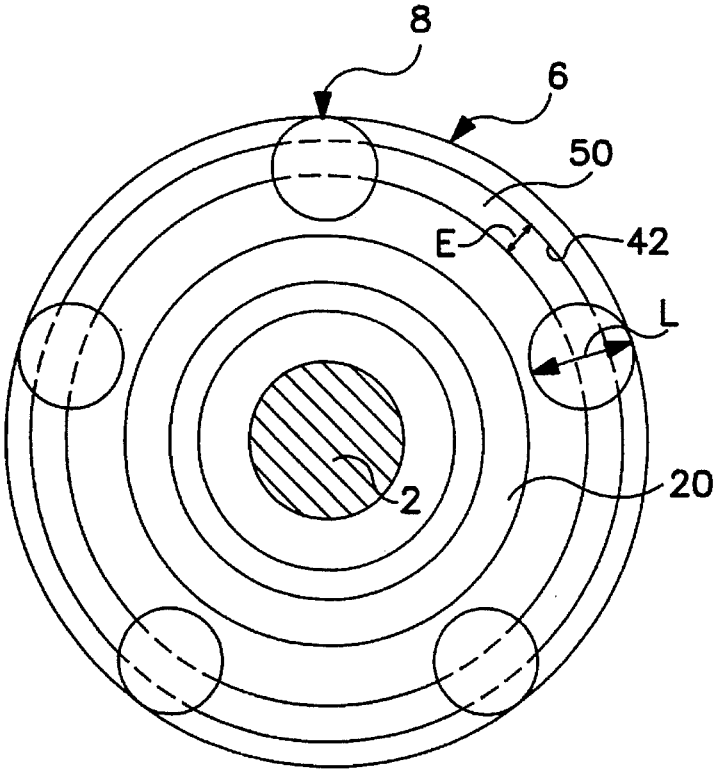
FIG. 7 is a side view of the swash plate, taken along the line VII—VII of FIG. 6.

FIGS. 6 and 7 illustrate a third preferred embodiment. An elastic member 50 in the shape of an annular ring is forcibly inserted into grooves 32 and 42. The axial surface of elastic member 50 preferably slightly projects beyond front axial surface 19 and rear axial surface 20. While, in the third preferred embodiment, the width E of grooves 32 and 42 is depicted as being smaller than the diameter L of shoes 8, width E of grooves 32 and 42 can be larger than diameter L of shoes 8. Further, instead of using forcible insertion, elastic member 50 may be secured to grooves 32 and 42 by an adhesive material. Elastic member 50 is preferably able to contain lubricating oil, e.g., polytetrafluorothylene. According to the third preferred embodiment, shoes 8 smoothly slide on front axial surface 19 and rear axial surface 20 due to the lubricating effect of elastic member 50.

Figure 8:
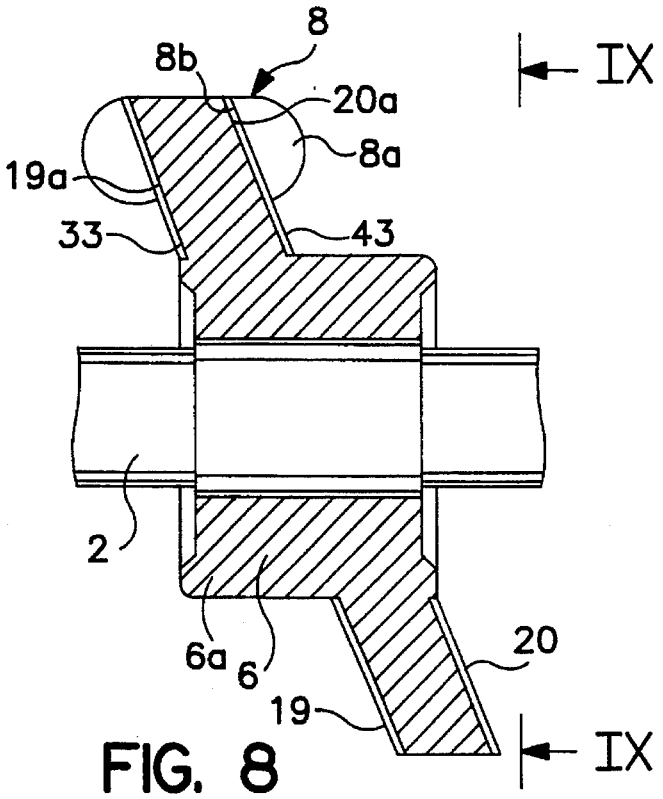
FIG. 8 is an enlarged cross-sectional view of a swash plate supported on a drive shaft and shoes engaging the swash plate in accordance with a fourth preferred embodiment.
Figure 9:
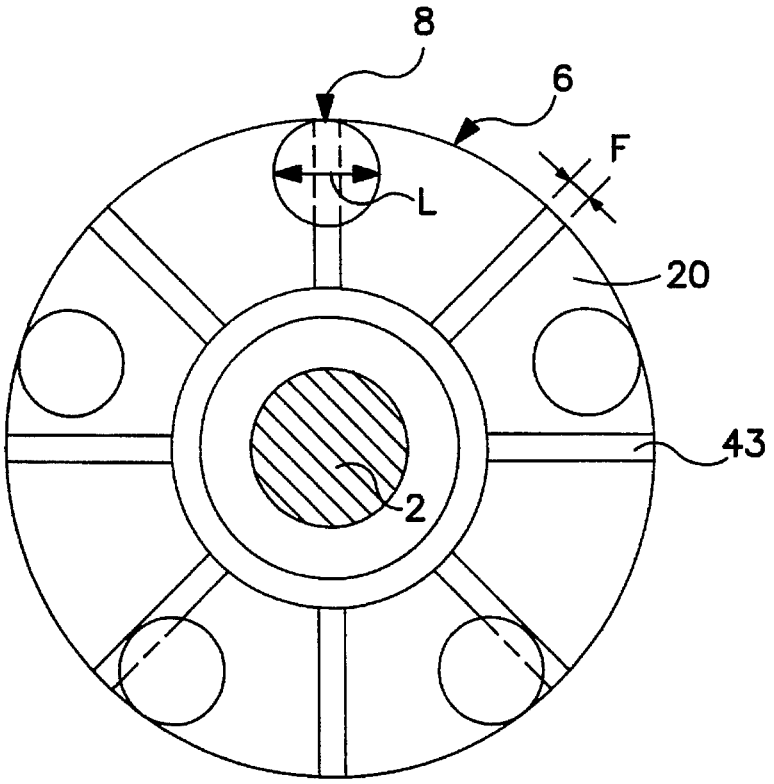
FIG. 9 is a side view of the swash plate, taken along the line IX—IX of FIG. 8.

FIGS. 8 and 9 illustrate a fourth preferred embodiment. In this embodiment, front axial surface 19 and rear axial surface 20 have a plurality of grooves 43 radially extending from an outer end of core 6*a* of swash plate 6. Grooves 33 and 43 preferably radially extend to sliding surface region 19*a* and 20*a*. Grooves 33 and 43 preferably extend linearly along front axial surface 19 and rear axial surface 20 and preferably have half-circle, rectangular or triangular cross-sectional profiles. Radial width F of grooves 33 and 43 is preferably less than a third of the diameter L of shoes 8. Further in this preferred embodiment, grooves 33 and 43 may be formed along halfcircles corresponding to the bottom dead center of pistons 5.

In either configuration of the fourth preferred embodiment, oil in the refrigerant gas is constantly supplied to groove 31 and groove 41, by the centrifugal force of swash plate 6.

Figure 10:
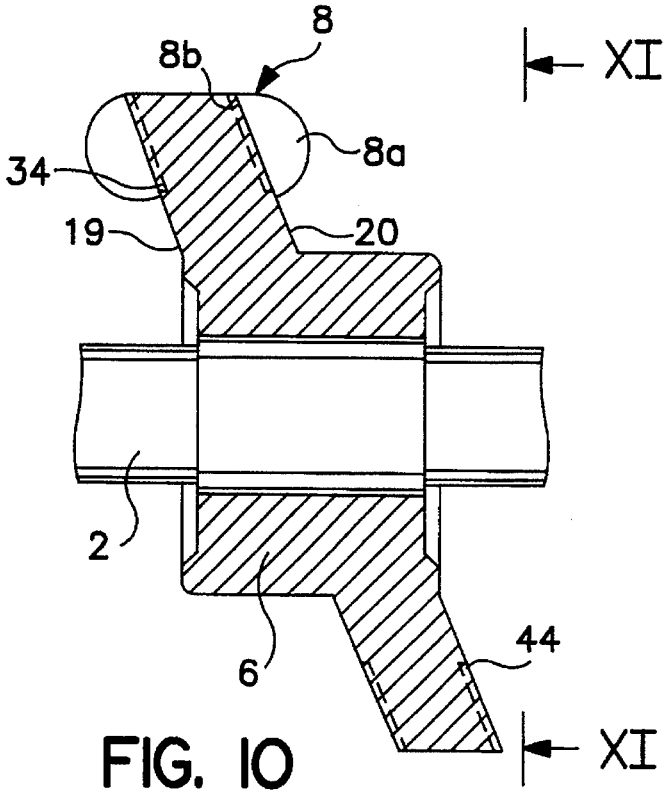
FIG. 10 is an enlarged cross-sectional view of a swash plate supported on a drive shaft and shoes engaging the swash plate in accordance with a fifth preferred embodiment.
Figure 11:
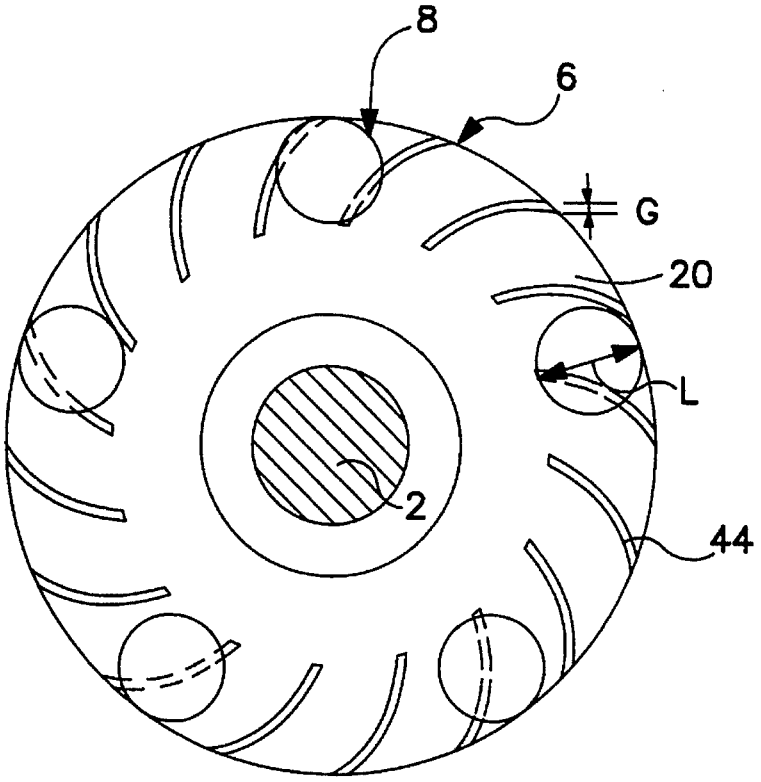
FIG. 11 is a side view of the swash plate, taken along the line XI—XI of FIG. 10.

FIGS. 10 and 11 illustrate a fifth preferred embodiment. In this embodiment, swash plate 6 includes a plurality of grooves 34 and 44 in front axial surface 19 and rear axial surface 20 thereof. Grooves 34 and 44 are preferably curved and have a substantially constant radius of curvature. Grooves 34 and 44 are spaced such that shoes 8 continuously overlap at least one groove 34 and 44. Furthermore, grooves 34 and 44 may be formed symmetrical to line Y so that, if the compressor counter-rotates, lubricating oil is delivered to shoes 8 at least during half of the rotation. Radial width G of grooves 34 and 44 is preferably less than a third of the diameter L of shoes 8.

In either configuration of the fifth preferred embodiment, circular flat surface 8*b* of shoes 8 always covers at least one of grooves 34 and 44 during the rotation of swash plate 6.

Figure 12:
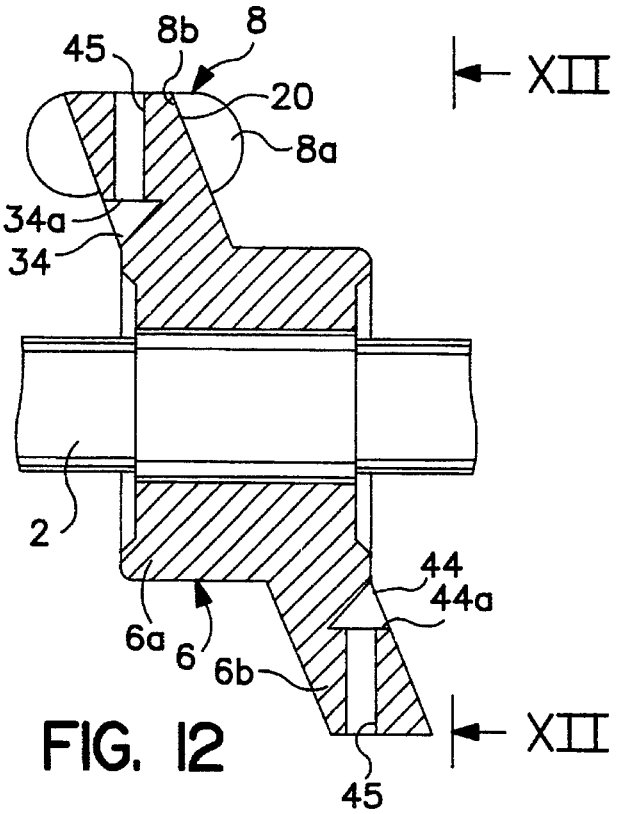
FIG. 12 is an enlarged cross-sectional view of a swash plate supported on a drive shaft and shoes engaging the swash plate in accordance with a sixth preferred embodiment.
Figure 13:
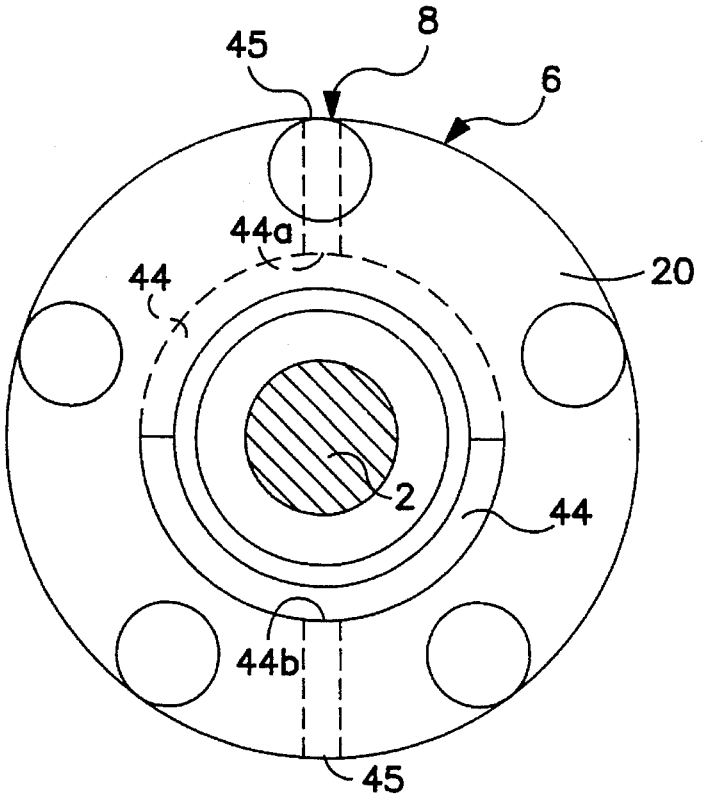
FIG. 13 is a side view of the swash plate, taken along the line XIII—XIII of FIG. 12.

FIGS. 12 and 13 illustrate a sixth preferred embodiment. In this embodiment, swash plate 6 includes a plurality of grooves 34 and 44 shaped as half-circular arcs along a radial end of core 6*a* of swash plate 6. Grooves 34 and 44 correspond to the bottom dead center of piston 5 so that they can capture the lubricating oil in the refrigerant gas. Further, swash plate 6 includes apertures 45 extending from the radial end 34*a* and 44*a* of grooves 34 and 44 and penetrating through the inside of swash plate 6. Apertures 45 extend substantially radially with respect to drive shaft 2 so that lubricating oil in the refrigerant gas passes into the central recessed portion 5*b* of pistons 5 by the centrifugal force of rotating motion of swash plate 6. Alternatively, a plurality of apertures 45 may extend within, and with an angle opposite to the slant angle of, swash plate 6.

In this embodiment, oil contained in the refrigerant gas which enters groove 44 is discharged from the radial end of swash plate 6 to central recessed portion 5*b* of piston 5. The lubricating oil then flows down central recessed portion 5*b* whereupon it comes into contact with sliding surface regions 19*a* and 20*a* between swash plate 6 and shoes 8.

According to the foregoing description of the preferred embodiments, the engaging surfaces between the swash plate and shoes are sufficiently lubricated by the lubricating oil in the refrigerant gas. As a result, local abrasion of the contact surfaces between the swash plate and the shoes is considerably decreased, and a seizure of the shoes on the swash plate is effectively prevented.

Although the present invention has been described in connection with the preferred embodiments, the invention is not limited thereto. For example, this invention is not restricted to a swash plate type compressor. It will be easily understood by those of ordinary skill in the art that variations and modifications can be easily made within the scope of this invention as defined by the appended claims.

We claim:

1. A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate for lubricating between said shoes and said swash plate, said lubricating means formed at least on the contacting surfaces corresponding to a portion of a compression stroke of the swash plate;

said at least one lubricating means formed eternally to and on the sliding surface of said swash plate;

wherein said lubricating means is a recessed portion formed in said contacting surfaces of said swash plate, wherein said recessed portion extends radially from a center of said swash plate.

2. A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate for lubricating between said shoes and said swash plate, said lubricating means formed at least on the contacting surfaces corresponding to a portion of a compression stroke of the swash plate;

said at least one lubricating means formed externally to and on the sliding surface of said swash plate;

wherein said lubricating means is a recessed portion formed in said contacting surfaces of said swash plate, wherein said recessed portion curvilinearly extends with a predetermined radius of curvature around a center of said swash plate.

3. A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate for lubricating between said shoes and said swash plate, said lubricating means formed at least on the contacting surfaces corresponding to a portion of a compression stroke of the swash plate;

said at least one lubricating means formed externally to and on the sliding surface of said swash plate;

wherein said lubricating means is a recessed portion formed in said contacting surfaces of said swash plate, wherein said recessed portion extends beyond said contacting surfaces in the direction of said drive shaft.

4. A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block, a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate for lubricating between said shoes and said swash plate, said lubricating means formed at least on the contacting surfaces corresponding to a portion of a compression stroke of the swash plate;

said at least one lubricating means formed externally to and on the sliding surface of said swash plate;

wherein said lubricating means comprises a polytetrafluoroethylene elastic member positioned in a recessed portion formed in said contacting surfaces of said swash plate.

5. A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate, said at least one lubricating means arranged to lubricate along said sliding surface of said swash plate corresponding to a top dead center of said swash plate;

said at least one lubricating means formed eternally to and on the sliding surface of said swash plate;

wherein said lubricating means is a recessed portion formed in said contacting surfaces of said swash plate, said recessed portion partially circularly extending around said swash plate.

6.

A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate, said at least one lubricating means arranged to lubricate along said sliding surface of said swash plate corresponding to a top dead center of said swash plate;

said at least one lubricating means formed externally to and on the sliding surface of said swash plate;

wherein said lubricating means is a recessed portion formed in said contacting surfaces of said swash plate, said recessed portion extends radially from a center of said swash plate.

7. A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate, said at least one lubricating means arranged to lubricate along said sliding surface of said swash plate corresponding to a top dead center of said swash plate;

said at least one lubricating means formed externally to and on the sliding surface of said swash plate;

wherein said lubricating means is a recessed portion formed in said contacting surfaces of said swash plate, said recessed portion curvilinearly extends with a predetermined radius of curvature around a center of said swash plate.

8. A swash plate type refrigerant compressor comprising:

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate; and at least one lubricating means associated with at least one of said contacting surfaces of said swash plate, said at least one lubricating means arranged to lubricate along said sliding surface of said swash plate corresponding to a top dead center of said swash plate;

said at least one lubricating means formed eternally to and on the sliding surface of said swash plate;

wherein said lubricating means is a polytetrafluoroethylene elastic member positioned in a recessed portion formed in said contacting surfaces of said swash plate.

9. A swash plate type refrigerant compressor comprising;

a compressor housing enclosing therein a crank chamber, a suction chamber and a discharge chamber, said compressor housing including a cylinder block;

a plurality of cylinder bores formed in said cylinder block;

a plurality of pistons slidably disposed within corresponding said cylinder bores, each of said pistons having a corresponding axis;

a drive shaft rotatably supported in said cylinder block;

a swash plate tiltably connected to said drive shaft and having a pair of sliding surfaces at axial sides thereof, said sliding surfaces having contacting surfaces where a plurality of pairs of shoes and said sliding surfaces engage, said shoes coupling said swash plate to said pistons so that said pistons may be driven in a reciprocating motion within said cylinder bores upon rotation of said swash plate;

at least one recessed portion associated with said sliding surfaces; and at least one passage communicating with said at least one recessed portion and extending within said swash plate;

wherein said passage extends from a radial end surface of said recessed portion to an outer radial end of said swash plate.

10. The swash plate type compressor of claim 9, wherein said passage extends substantially to said drive shaft.

* * * * *